United States Patent [19]

Ikeda et al.

[11] Patent Number: 4,771,034

[45] Date of Patent: Sep. 13, 1988

[54] RECORDING MATERIALS

[75] Inventors: Kensuke Ikeda; Ken Iwakura; Masato Satomura, all of Shizuoka, Japan

[73] Assignee: Fuji Photo Film Co., Ltd., Kanagawa, Japan

[21] Appl. No.: 916,430

[22] Filed: Oct. 7, 1986

[30] Foreign Application Priority Data

| | | | |
|---|---|---|---|
| Oct. 7, 1985 | [JP] | Japan | 60-223340 |
| Oct. 23, 1985 | [JP] | Japan | 60-237060 |
| Jan. 22, 1986 | [JP] | Japan | 61-11242 |
| Apr. 8, 1986 | [JP] | Japan | 61-80641 |

[51] Int. Cl.[4] ..... B41M 5/16; B41M 5/18; B41M 5/22

[52] U.S. Cl. ..... 503/212; 427/150; 503/213; 503/216; 503/225

[58] Field of Search ..... 346/216, 217, 225; 427/150–152; 503/210–213, 216, 217, 225

[56] References Cited

U.S. PATENT DOCUMENTS

| | | | |
|---|---|---|---|
| 3,896,255 | 7/1975 | Kato et al. | 346/225 |
| 3,924,027 | 12/1975 | Saito et al. | 427/150 |
| 4,051,303 | 9/1977 | Hayashi et al. | 346/225 |

*Primary Examiner*—Bruce H. Hess

*Attorney, Agent, or Firm*—Sughrue, Mion, Zinn, Macpeak and Seas

[57] ABSTRACT

A recording material containing an electron donating leuco dye and an electron accepting compound, wherein said electron accepting compound is a salicyclic acid derivative having an alkyl group, an alkoxy group or an aryloxy group as a substituent or a metal salt thereof. The recording material has satisfactory color developability, working preservability and stability.

20 Claims, No Drawings

RECORDING MATERIALS

FIELD OF THE INVENTION

This invention relates to a recording material and, more particularly, to a recording material using an electron donating leuco dye and an electron accepting compound, which has improved color developability, improved working preservability and improved stability of a developed color image.

BACKGROUND OF THE INVENTION

Color reaction between electron donating leuco dyes and electron accepting compounds is well known and has been embodied into two-component-system recording materials, such as pressure-sensitive paper, heat-sensitive paper, photo- and pressure-sensitive paper, electrothermal recording paper, and the like. References can be made to it, e.g., in British Pat. No. 2,140,449, U.S. Pat. Nos. 4,480,052 and 4,436,920, Japanese Patent Publication No. 23922/85 and Japanese Patent Application (OPI) Nos. 179836/82, 123556/85 and 123557/85 (the term "OPI" as used herein refers to a "published unexamined Japanese patent application").

Performance properties that should be fulfilled by these recording materials include (1) sufficient color density to be developed and sufficient color development sensitivity, (2) freedom from fog, (3) sufficient fastness of a developed color image, (4) appropriate hues form when developed and suitability for use on copying machines, (5) high S/N radios, (6) sufficient chemical resistance of a developed color image, and the like. However, none of the conventional recording materials satisfies all of these requirements.

In particular, heat-sensitive recording materials which have undergone a marked development in recent years have disadvantages of fog due to solvents, etc., and discoloration or decoloration of a developed color image due to fats and oils, chemicals, etc. That is, upon contact with stationeries or office supplies, e.g., aqueous ink pens, oily ink pens, fluorescent pens, inkpads, adhesives, pastes, diazo developers, etc., cosmetics, e.g., hand creams, milky lotions, etc., the white background develops a color or a color developed area undergoes discoloration to thereby seriously impair commercial value.

In order to solve these problems, efforts have been made by providing a chemical resistant protective layer, etc., as disclosed in Japanese Patent Publication No. 27880/69, Japanese Patent Application (OPI) Nos. 30437/73 and 31958/73, etc. However, provision of a protective layer not only causes reduction in color development sensitivity, sticking or noise on recording due to insufficient matching with a thermal head of a heat-sensitive recording device, blotting with an ink due to poor writing properties and the like, but also makes the production process complicated.

Further, various attempts have been made to improve stability of a developed color image as disclosed in Japanese Patent Publication No. 43386/76, Japanese Patent Application (OPI) Nos. 17347/78, 72996/81 and 194891/84, British Patent Publication No. 2,074,335A, etc However, the stabilizing effect attained is still unsatisfactory, or if any effect being obtained, the white background undergoes color development (i.e., fog).

SUMMARY OF THE INVENTION

In order to obtain satisfactory recording materials and components therefor, the inventors have conducted research on both electron donative leuco dyes and electron accepting compounds, taking notice of various characteristics, such as oil solubility, water solubility, partition coefficient, pKa value, polarity and position of substituents, changes in crystallizing properties and solubility when used in combination, and the like.

Accordingly, an object of this invention is to provide a recording material which has satisfactory color developability, working preservability and stability of a developed color image and also satisfies all the other required conditions.

It has now been found that the above object of this invention can be accomplished by using a salicylic acid derivative having an alkyl group, an alkoxy group or an aryloxy group or a metal salt thereof as an electron accepting compound.

Further, it has been found that a process for preparing an alkoxysalicylic acid derivative, which is simple and convenient to operate, and a purification procedure of which is easy, can be achieved by a process for preparing an alkoxysalicylic acid derivative which comprises reacting a hydroxysalicylic acid derivative with an alkyl halide or an alkyl sulfonate in a polar solvent.

DETAILED DESCRIPTION OF THE INVENTION

The salicylic acid derivatives and metal salts thereof which can preferably be used in the present invention are represented by the formula (I):

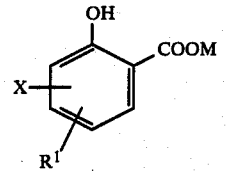

(I)

wherein $R^1$ represents a substituted or unsubstituted alkyl group having from 7 to 18 carbon atoms to be bonded to the para-position with respect to the COOM group, a substituted or unsubstituted alkoxy group having from 7 to 18 carbon atoms or a substituted or unsubstituted aryloxy group having from 6 to 18 carbon atoms; X represents a hydrogen atom, a substituted or unsubstituted alkyl group, a substituted or unsubstituted alkoxy group or a halogen atom; and M represents a hydrogen atom or $M_1^{1/n}$, wherein $M_1$ represents an n-valent metal atom, and n represents an integer corresponding to the valence number of the metal atom, preferably 1 to 3.

In the above-described formula (I), the alkyl group includes a saturated or unsaturated, substituted or unsubstituted alkyl group or cycloalkyl group. The substituents for the alkyl and the alkoxy group include an aryl group, an alkoxy group, an aryloxy group, a halogen atom, an acylamino group, an aminocarbonyl group, a cyano group, etc. The aryloxy group includes a substituted or unsubstituted phenyl group, a substituted or unsubstituted naphthyl group or a substituted or unsubstituted heterocyclic aromatic ring. The substituents for the aryloxy group include an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

X in the formula (I) preferably represents a hydrogen atom, a substituted or unsubstituted alkyl group having from 1 to 9 carbon atoms, a substituted or unsubstituted alkoxy group having from 1 to 5 carbon atoms, a chlorine atom or a fluorine atom.

The metal atom represented by $M_1$ in the formula (I) is preferably selected from the group including zinc, aluminum, magnesium and calcium.

Among the above-described salicylic acid derivatives and metal salts thereof of formula (I), compounds of the following formula (II) are more preferred.

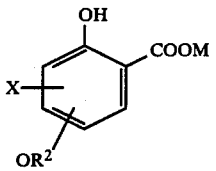

(II)

wherein X and M are as defined above; and $R^2$ represents a substituted or unsubstituted alkyl group or a substituted or unsubstituted aryl group.

$R^2$ in the formula (II) preferably represents an alkyl group having from 1 to 30 carbon atoms or an aryl group having from 6 to 24 carbon atoms. The substituents for the alkyl group as represented by $R^2$ preferably include an aryl group, an alkoxy group, a halogen atom and an acylamino group, and those for the aryl group for $R^2$ preferably include an alkyl group, an alkoxy group, a halogen atom, a phenyl group and a substituted carbamoyl group.

The group $—OR^2$ in the formula (II) is preferably bonded to the ortho- or para-position, and more preferably para-position, with respect to the —COOM group. The compounds (II) wherein the group $—OR^2$ is bonded at the meta-position unfavorably suffer from fog for some inexplicable reason.

Among the above-described salicylic acid derivatives and metal salts thereof of formula (II), compounds of the following formula (III) are particularly preferred.

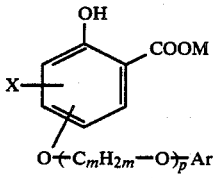

(III)

wherein X and M are as defined above; Ar represents a substituted or unsubstituted aryl group; m represents an integer of from 1 to 10; and p represents an integer of 1 to 3.

Ar in the formula (III) preferably represents an aryl group having from 6 to 22 carbon atoms. The substituents for the aryl group as represented by Ar preferably include an alkyl group having from 1 to 12 carbon atoms, an aralkyl group having from 7 to 16 carbon atoms, an alkoxy group having from 1 to 12 carbon atoms, a halogen atom, a phenyl group and an alkoxycarbonyl group. Specific examples of the preferred aryl group for Ar include a phenyl group, a tolyl group, an ethylphenyl group, a propylphenyl group, a butylphenyl group, a cyclohexylphenyl group, an octylphenyl group, a nonylphenyl group, a dodecylphenyl group, a benzylphenyl group, a phenethylphenyl group, a cumylphenyl group, a xylyl group, a diphenethylphenyl group, a methoxyphenyl group, an ethoxyphenyl group, a benzyloxyphenyl group, an octyloxyphenyl group, a dodecyloxyphenyl group, a chlorophenyl group, a fluorophenyl group, a phenylphenyl group, a hexyloxycarbonylphenyl group, a benzyloxycarbonylphenyl group, a dodecyloxycarbonylphenyl group, a naphthyl group, a methylnaphthyl group, a chloronaphthyl group, etc.

The group of $—O(C_mH_{2m}—O)_pAr$ in the formula (III) is preferably bonded to the ortho-, meta- or para-position, and more preferably the para-position, with respect to the COOM group. The m preferably represents an integer of 1 to 10, more preferably 2, and the p preferably represents an integer of 1 to 3, more preferably 1.

In view of water insolubility, the total carbon atom number of the compounds of the formula (I) is preferably 15 or more; of formula (II) is 12 or more and more preferably 16 or more; and of formula (III) is 12 or more and more preferably 14 or more.

Specific examples of the salicylic acid derivatives or metal salts thereof represented by the formula (I) are 4-n-dodecylsalicylic acid, 4-t-dodecylsalicylic acid, 4-n-pentadecylsalicylic acid, 4-n-heptadecylsalicylic acid, 4-(1,3-diphenylbutyl)salicylic acid, 4-n-octadecylsalicylic acid, 4-dodecylsulfonylsalicylic acid, 4-dodecylsulfosalicylic acid, 4-hexyloxysalicylic acid, 4-cyclohexyloxysalicylic acid, 4-octyloxysalicylic acid, 4-decyloxysalicylic acid, 4-dodecyloxysalicylic acid, 4-tetradecyloxysalicylic acid, 4-pentadecyloxysalicylic acid, 4-hexadecyloxysalicylic acid, 4-octadecyloxysalicylic acid, 4-eicosyloxysalicylic acid, 4-triacontyloxysalicylic acid, 4-oleyloxysalicylic acid, 4-β-phenethyloxysalicylic acid, 4-β-dodecyloxyethoxysalicylic acid, 4-(12-chlorododecyl)oxysalicylic acid, 4-β-N-stearoylaminoethoxysalicylic acid, 4-β-N-myristoylaminoethoxysalicylic acid, 4-β-perfluorohexylethoxysalicylic acid, 4-dodecyloxy-5-chlorosalicylic acid, 4-dodecyloxy-5-methylsalicylic acid, 4-dodecyloxy-6-methylsalicylic acid, 4-dodecyloxy-6-phenylsalicylic acid, 4-methoxy-6-dodecyloxysalicylic acid, 6-octadecyloxysalicylic acid, 4-p-t-octylphenyloxysalicylic acid, 4-p-dodecyloxyphenyloxysalicylic acid, 4-p-chlorophenoxy-6-butylsalicylic acid, 4-p-phenylphenoxysalicylic acid, 4-p-N-myristoylcarbamoylphenyloxysalicylic acid, 4-benzyloxy-6-dodecyloxysalicylic acid, etc., and salts thereof with zinc, aluminum, 4-β-phenoxyethoxysalicylic acid, 4-(4-phenoxybutoxy)salicylic acid, 4-(6-phenoxyhexyloxy)salicylic acid, 4-(5-phenoxyamyloxy)salicylic acid, 4-(8-phenoxyoctyloxy)salicylic acid, 4-(10-phenoxydecyloxy)salicylic acid, 4-β-p-tolyloxyethoxysalicylic acid, 4-β-m-tolyloxyethoxysalicylic acid, 4-β-o-tolyloxyethoxysalicylic acid, 4-β-p-ethylphenoxyethoxysalicylic acid, 4-β-p-isopropylphenoxysalicylic acid, 4-β-p-t-butylphenoxyethoxysalicylic acid, 4-β-p-cyclohexylphenoxyethoxysalicylic acid, 4-β-p-t-octylphenoxyethoxysalicylic acid, 4-β-p-nonylphenoxyethoxysalicylic acid, 4-β-p-dodecylphenoxyethoxysalicylic acid, 4-β-p-benzylphenoxyethoxysalicylic acid, 4-(2-p-α-phenethylphenoxyethoxy)salicylic acid, 4-β-o-methoxyphenoxyethoxysalicylic acid, 4-β-p-cumyloxyethoxysalicylic acid, 4-β-(2,4-dimethylphenoxy)ethoxysalicylic acid, 4-β-(3,4-dimethylphenoxy)ethoxysalicylic acid, 4-β-(3,5-dimethylphenoxy)ethoxysalicylic acid, 4-β-(2,4-bis-α-phenethylphenoxy)ethoxysalicylic acid, 4-β-p-methoxyphenoxyethoxysalicylic acid, 4-β-p-ethoxyphenoxyethoxysalicylic acid, 4-β-p-benzyloxyphenoxyethoxysalicylic acid, 4-β-p-dodecyloxyphenoxyethoxysalicylic acid, 4-β-p-chlorophenoxyethoxysalicylic acid, 4-β-p-phenylphenoxyethoxysalicylic acid, 4-β-p-cyclohexylphenoxyethoxysalicylic acid, 4-β-p-benzyloxycarbonylphenoxyethoxysalicylic acid, 4-β-p-dodecyloxycarbonylphenoxyethoxysalicylic acid, 4-β-2'-naphthyloxyethoxysalicylic acid, 5-β-p-ethylphenoxyethoxysalicylic acid, 4-β-phenoxyethoxy-6-methylsalicylic acid, 4-β-phenoxyethoxy-6-chlorosalicylic acid, 4-β-phenoxyisopropyloxysalicylic acid, 4-(5-p-methoxyphenoxy-3-oxapentyl)oxysalicylic acid, 4-(5-p-tolyloxy-3-oxapentyl)oxysalicylic acid, 4-(8-p-methoxyphenoxy-3,6-dioxaoctyl)oxysalicylic acid, etc., and salts thereof with zinc, aluminum, calcium, etc.

These electron accepting compounds may be used either individually or in combinations of two or more thereof.

Since the recording materials using the above-described salicylic acid derivatives provide sufficiently high color densities and the developed colors are markedly stable, they undergo substantially no decoloration or discoloration even when exposed to light, heat or moisture for a long period of time. Thus, they are especially advantageous from the viewpoint of long-term storage of recorded information. Further, when the salicylic derivatives of the present invention are applied to heat-sensitive recording materials, the undeveloped areas do not develop a color upon contact with solvents, etc., and the developed areas do not undergo color change upon contact with fats and oils, chemicals, etc. Therefore, these compounds perform excellently as electron accepting compounds for two-component-system recording materials.

The electron accepting compounds according to the present invention may be used in combination with other known electron accepting compounds, such as salicylic acid derivatives other than those of the present invention, phenol derivatives, phenol resins, acid clay, and the like. Illustrative examples of these electron accepting compounds include 4-t-butylphenol, 4-phenylphenol, 4-hydroxydiphenoxide, α-naphthol, β-naphthol, hexyl-4-hydroxybenzoate, 2,2'-dihydroxybiphenyl, 2,2-bis(4-hydroxyphenyl)propane (bisphenol A), 4,4'-isopropylidenebis(2-methylphenol), 1,1-bis(3-chloro-4-hydroxyphenyl)cyclohexane, 1,1-bis(3-chloro-4-hydroxyphenyl)-2-ethylbutane, 4,4'-sec-isooctylidenediphenol, 4-t-octylphenol, 4,4'-sec-butylidenediphenol, 4-p-methylphenylphenol, 4,4'-isopentylidenediphenol, 4,4'-methylcyclohexylidenediphenol, 4,4'-dihydroxydiphenylsulfide, 1,4-bis(4'-hydroxycumyl)benzene, 1,3-bis-(4'-hydroxycumyl)benzene, 4,4'-thiobis(6-t-butyl-3-methylphenol), 4,4'-dihydroxydiphenylsulfone, hydroquinonemonobenzyl ether, 4-hydroxybenzophenone, 2,4dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylbenzoate, ditolylthiourea, 4,4'-diacetyldiphenylthiourea, aromatic carboxylic acids, e.g., 3-phenylsalicylic acid, 3-cyclohexylsalicylic acid, 3,5-di-t-butylsalicylic acid, 3,5-didodecylsalicylic acid, 3-methyl-5-benzylsalicylic acid, 3-phenyl-5-(α,α-dimethylbenzyl)salicylic acid, 3,5-di(α-methylbenzyl)salicylic acid, 2-hydroxy-1-benzyl-3-naphthoic acid, 3,5-dicyclopentadienylsalicylic acid, bis(3-vinyl-4-hydroxyphenyl)sulfone, 4-(2-vinyl-4-p-hydroxyphenylsulfonyl)phenol, 2,2-bis(3-vinyl-4-hydroxyphenyl)propane, etc. Phenol resins, e.g., p-phenylphenol-formaldehyde resin, p-butylphenolacetylene resin, etc., and the like; as well as salts of these organic color developers with polyvalent metals, e.g., zinc, magnesium, aluminum, calcium, titanium, manganese, tin, nickel, etc.; inorganic color developers, such as inorganic acids, e.g., hydrohalogenic acids (e.g., hydrochloric acid, hydrobromic acid and hydroiodic acid), boric acid, silicic acid, phosphoric acid, sulfuric acid, nitric acid, perchloric acid, halides of aluminum, zinc, nickel, tin, titanium, boron, etc.; acid clay, active clay, attapulgite, bentonite, colloidal silica, aluminum silicate, magnesium silicate, zinc silicate, tin silicate, zinc rhodanide, zinc chloride, iron stearate, cobalt naphthenate, nickel peroxide, ammonium nitrate, and the like; aliphatic carboxylic acids, such as oxalic acid, maleic acid, tartaric acid, citric acid, succinic acid, stearic acid, etc.; and aromatic carboxylic acids, such as benzoic acid, p-t-butylbenzoic acid, phthalic acid, gallic acid, etc.

The electron donating leuco dyes which can be used in the present invention include triphenylmethanephthalide compounds, fluoran compounds, triarylmethane compounds, diphenylmethane compounds, xanthene compounds, thiazine compounds, indolylphthalide compounds, leucoauramine compounds, rhodamine lactam compounds, triazene compounds, spiropyran compounds and the like. The typical examples of phthalide compounds are a compound as described, for example, in U.S. Pat. No. Re. 23,024, U.S. Pat. Nos. 3,491,111, 3,491,112, 3,491,116, 3,509,174; the typical examples of fluoran compounds are a compound as described, for example, in U.S. Pat. Nos. 3,624,107, 3,627,787, 3,641,011, 3,462,828, 3,681,390, 3,920,510 and 3,959,571; the typical examples of spiropyran compounds are a compound as described, for example, in U.S. Pat. No. 3,971,808; and the typical examples of pyridine or pyrazine coloring compounds are a compound as described, for example, in U.S. Pat. Nos. 3,775,424, 3,853,869 and 4,246,318. Illustrative examples of these electron donating leuco dyes include triarylmethane compounds, e.g., 3,3-bis(p-dimethylaminophenyl)-6-dimethylaminophthalide (Crystal Violet Lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc.; diphenylmethane compounds, e.g., 4,4'-bisdimethylaminobenzhydrine benzyl ether, N-halophenyl-leucoauramine, N-2,4,5-trichlorophenyl-leucoauramine, etc.; xanthene compounds, e.g., rhodamine-B-anilinolactam, rhodamine (p-nitroanilino)lactam, rhodamine-B-(p-chloroanilino)-lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methyl-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, 2-o-toluidino-3-methyl-6-diisopropylamino-4',5'-dimethylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran, etc.; thiazine compounds, e.g., benzoyl Leucomethylene Blue, p-nitrobenzoyl Leucomethylene Blue, etc.; and spiro compounds, e.g., 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)spiropyran, 3-propyl-spiro-dibenzopyran, etc.

Of these electron donating compounds, the triarylmethane compounds and xanthene compounds are preferred because materials containing these compounds have less fog and high color density. The more preferred are xanthene compounds represented by the formula (IV):

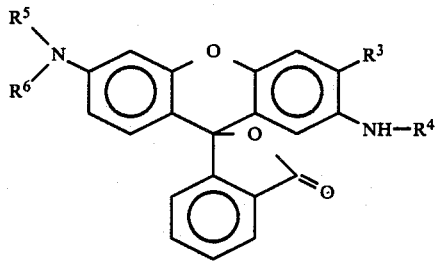

(IV)

wherein $R^5$ and $R^6$ each represents a substituted or unsubstituted straight chain or branched alkyl group having from 1 to 10 carbon atoms or a cycloalkyl group; $R^3$ represents an alkyl group having from 1 to 10 carbon atoms or a halogen atom; and $R^4$ represents a substituted or unsubstituted aryl group; the alkyl groups represented by $R^5$ and $R^6$ may form a ring.

In the formula (IV), $R^5$ and $R^6$ each preferably represents a substituted or unsubstituted straight chain or branched alkyl group having from 1 to 10 carbon atoms. $R^3$ preferably represents an alkyl group having from 1 to 8 carbon atoms or a chlorine atom, and more preferably a methyl group or a chlorine atom. $R^4$ preferably represents a substituted or unsubstituted aryl group having from 6 to 20 carbon atoms, and more preferably a substituted or unsubstituted phenyl group. The substituent for the phenyl group as represented by $R^4$ preferably includes an aryl group having from 1 to 10 carbon atoms and more preferably an alkyl group having from 1 to 8 carbon atoms.

These electron donating leuco dyes may be used individually, or two or more of them may be mixed for the purpose of tone control and prevention of discoloration of a developed color image.

In preparation of recording materials, the above-described leuco dyes and electron accepting compounds are used in the form of fine dispersion or microcapsules.

Pressure-sensitive recording materials to which the present invention is applicable can have various embodiments as taught in, e.g., U.S. Pat. Nos. 2,505,470, 2,505,471, 2,505,489, 2,548,366, 2,712,507, 2,730,456, 2,730,457, 3,103,404, 3,418,250, 4,010,038, etc. The most commonly employed embodiment comprises at least one pair of sheets, in which the electron donating leuco dyes and the electron accepting compounds are separately incorporated.

Microcapsules of the leuco dyes or electron accepting compounds can be prepared by a process utilizing coacervation of a hydrophilic colloid sol as described in U.S. Pat. Nos. 2,800,457 and 2,800,458, an interfacial polymerization process as described in British Pat. Nos. 867,797, 950,443, 989,264, 1,091,076, etc., or the process described in U.S. Pat. No. 3,103,404.

In general, the electron donating leuco dye or dyes is/are dissolved in a solvent, such as synthetic oils, e.g., alkylated naphthalenes, alkylated diphenyls, alkylated diphenylmethanes, alkylated terphenyls, chlorinated paraffins, etc.; vegetable oils, e.g., cotton seed oil, castor oil, etc.; animal oils; mineral oil; and mixtures thereof; and the resulting solution is encapsulated to form a coating composition. The coating composition is then coated on a support, e.g., paper, fine paper, a plastic sheet, resin-coated paper, etc., to form a color forming sheet. On the other hand, a color developing sheet is prepared by dispersing the electron accepting compound or compounds of the invention and, if necessary, other known electron accepting compounds in a binder, e.g., a styrene-butadiene latex, polyvinyl alcohol, etc., mixing the dispersion with additives, such as pigments as hereinafter described, and coating the resulting coating composition on a Support, e.g., paper, a plastic sheet, resin-coated paper, etc.

The amounts of the electron donating leuco dyes and electron accepting compounds to be used can easily be decided by one skilled in the art depeding on the desired coverage, the structual form of the pressure-sensitive recording material, the process adopted for preparing microcapsules, and other condittions.

The electron donating leuco dyes are preferably used in an amount of 0.02 to 0.2 g/m$^2$, and the electron accepting compounds are preferably used in an amount of 0.01 to 1 g/m$^2$, when used for the pressure-sensitive recording material.

When the present invention is applied to heat-sensitive recording materials, each of the electron donating leuco dye and the electron accepting compound is ground and dispersed in a dispersion medium to aparticle size of 10 μm or less, preferably 5 μm or less, more preferably 0.3 to 3 μm, by means of a ball mill, a sand mill, a horizontal sand mill, an attritor, a colloid mill, etc. The dispersion medium to be used includes aqueous solution of water-soluble high polymers at concentrations of from 0.5 to 10% by weight.

In the heat-sensitive recording materials, the electron donating leuco dyes are preferably used in an amount of 0.1 to 2.0 g/m$^2$, the electron accepting compounds are preferably used in an amount of 0.2 to 5.0 g/m$^2$, more preferably 0.2 to 2.0 g/m$^2$, and the water-soluble binder is used in an amount of 0.5 to 3 g/m$^2$.

A preferred weight ratio of the electron donating leuco dye to the electron accepting compound in a heat-sensitive recording layer is from about 1:10 to about 1:1 and more preferably from 1:5 to 2:3.

In order to improve heat sensitivity, the heat-sensitive recording layer can contain a heat-fusible substance. The heat-fusible substance which can be used in the present invention preferably has a melting point of from 75° to 130° C. and includes, for example, nitrogen-containing organic compounds, such as fatty acid amides, acetoacetic anilide, diphenylamine, benzamide, carbazole, stearic acid amide, palmitic acid amide, N-phenyl stearic acid amide, N-stearyl urea, etc.; 2,3-di-m-tolylbutane, o-fluorobenzoyldurene, chlorobenzoylmesitylene, 4,4'-dimethylbiphenyl; carboxylic acid esters, such as dimethyl isophthalate, diphenyl phthalate, dimethyl terephthalate, methacryloxybiphenyl, p-benzyloxy benzyl benzoate, β-naphthoic acid phenyl ester, 1-hydroxy-2-naphthoic acid phenyl ester, etc.; ether compounds, such as di-m-tolyloxyethane, β-phenoxyethoxyanisole, 1-phenoxy-2-p-ethylphenoxyethane, bis-β-(p-methoxyphenoxy)ethoxymethane, 1,2'-methylphenoxy-2''-ethylphenoxyethane, 1-tolyloxy-2-p-methylphenoxyethane, 1,2-diphenoxyethane, 1,4-diphenoxybutane, bis-β-(p-ethoxyphenoxy)ethyl ether, 1-phenoxy-2-p-chlorophenoxyethane, 1,2'-methylphenoxy-2,4''-ethyloxyphenoxyethane, 1,4'-methylphenoxy-2,4''-fluorophenoxyethane, 2-benzyloxynaphthalene, 2-p-chlorobenzyloxynaphthalene, 2-p-methylbenzyloxynaphthalene, 1-benzyloxynaphthalene, 1,4-p-tolyloxybutane, 1-phenoxy-2-p-tolyloxyethane, 1,5-bis-p-methoxyphenoxy-3-oxapentane, 1,2-bis-p-methoxyphenylthioethane, 4-β-phenethyloxybiphenyl, etc. These heat-fusible substances may be used either individually or in combination of two or more thereof. They are finely dispersed simultaneously with the leuco dye or the electron accepting compound. It is particularly preferable to disperse them together with the leuco dye from the standpoint of fog prevention. The amount of the heat-fusible substance to be used ranges from 20 to 300% by weight, and preferably from 40 to 150% by weight, based on the electron accepting compound.

The coating composition containing the electron donating leuco dye or electron accepting compound and, if desired, the heat-fusible substance, can further contain additives for satisfying various performance requirements. For example, contamination of a recording head on recording can be prevented by dispersing an oil absorbing substance, such as inorganic pigments, polyurea fillers, etc., in a binder. Further, fatty acids, metallic soaps, etc., can be added in order to increase releasability from a recording head. Other additives which can be added to a recording layer include pigments, waxes, antistatics, ultraviolet absorbents, defoaming agents, conductive materials, fluorescent dyes, surface active agents, and the like.

Specific examples of the pigments to be used include kaolin, calcined kaolin, talc, agalmatolite, diatomaceous earth, calcium carbonate, aluminum hydroxide, magnesium hydroxide, plaster of Paris, silica, magnesium carbonate, titanium oxide, alumina, barium carbonate, barium sulfate, mica, microbaloons, urea-formaldehyde fillers, polyethylene particles, cellulose fillers, zinc oxide, lithopone, amorphous silica, and the like. These pigments have a particle size of from 0.1 to 15 μm. In the dispersion of the zinc salt of the electron accepting compound of the present invention, it is particularly preferable to disperse them together with zinc oxide since the stabilizing effect of a developed color image can be improved without causing the color disappearance or discoloration thereof.

Specific examples of waxes to be used include paraffin wax, carboxyl-modified paraffin wax, carnauba wax, microcrystalline wax, polyethylene wax, higher fatty acid esters, methylol stearamide, polystyrene wax, etc.

Specific examples of metallic soaps to be used include higher fatty acid polyvalent metal salts, e.g., zinc stearate, aluminum stearate, calcium stearate, zinc oleate, etc.

Binders in which these components are dispersed are generally water-soluble. The preferred examples of the binders are a compound having a solubility of 5 wt % or more in water at 25° C. The typical examples thereof include polyvinyl alcohol, hydroxyethyl cellulose, hydroxypropyl cellulose, epichlorohydrin-modified polyamide, an ethylene-maleic anhydride copolymer, a styrene-maleic anhydride copolymer, an isobutylene-maleic anhydride copolymer, polyacrylic acid, polyacrylic amide, methylol-modified polyacrylamide, starch derivatives, casein, gelatin, methyl cellulose, carboxymethyl cellulose, gum arabic, carboxy-modified polyvinyl alcohol, a saponified product of copolymer of vinyl acetate and polyacrylic acid, and the like. The dispersion in such a binder may further contain a waterproofing agent, such as gelatinizing agents or crosslinking agents, or an emulsion of a hydrophobic polymer, e.g., a styrene-butadiene rubber latex, an acrylonitrilebutadiene rubber latex, a methyl acrylate-butadiene rubber latex, vinyl acetate emulsion, etc., for the purpose of imparting water resistance.

Specific examples of surface active agents to be used include a sulfosuccinic acid type alkali metal salt, a fluorine-containing surface active agent, etc.

The coating composition comprising the above-described components is coated on a base paper, fine paper, synthetic paper, a plastic sheet, neutral paper, etc., to a coverage of from 2 to 10 g/cm$^2$.

Resistance of a coating layer can be improved by providing a protective layer having a thickness of from 0.2 to 2 μm which comprises a water-dispersible polymeric compound, e.g., polyvinyl alcohol, hydroxyethyl starch, epoxy-modified polyacrylamide, etc., and a crosslinking agent.

In addition to the above-described embodiment, the heat-sensitive recording material to which the present invention is applicable includes other various embodiments as disclosed in German Patent Specification (OLS) Nos. 2,228,581 and 2,110,854, Japanese Patent Publication No. 20142/77, etc. It is possible to subject the recording material to pre-heating, moisture conditioning, elongation or the like operation prior to recording.

Electrothermic recording materials to which the present invention is applicable can be produced by the process as described, e.g., in Japanese Patent Application (OPI) Nos. 11344/74 and 48930/75. In general, the electrothermic recording materials according to the present invention can be produced by coating a dispersion comprising a conductive material, a basic dye mainly including the fluoran derivative of the present invention, the electron accepting compound of the present invention and a binder on a support, such as paper; or coating a conductive material on a support to form a conductive layer and then coating thereon a dispersion comprising the leuco dye, the electron accepting compound and a binder. The above-described heat-fusible substance can also be used in combination for the purpose of improving sensitivity.

Photo- and pressure-sensitive recording materials to which the present invention is applicable can be produced in accordance with the process as described, e.g., in Japanese Patent Application (OPI) No. 179836/82, etc. In general, a photopolymerization initiator, such as silver iodobromide, silver bromide, silver behenate, Michler's ketone, benzoin derivatives, benzophenone derivatives, etc., a polyfunctional monomer as a cross-linking agent, such as polyallyl compounds, poly(meth-)acrylates, poly(meth)acrylamides, etc., the leuco dye of the present invention and, if necessary, a solvent are encapsulized using a synthetic resin, e.g., polyether urethane, polyurea, etc., as a capsule wall material. After imagewise exposure, the leuco dye in the unexposed areas is brought into contact with a color developer to develop a color.

The electron accepting compounds according to the present invention can be synthesized by known processes. For example, they can be obtained by alkylating or arylating the corresponding hydroxysalicylic acid derivative.

Namely, the electron accepting compound according to the present invention can be obtained by reacting a phenolated hydroxysalicylic acid derivative with an alkyl halide or an alkyl sulfonate in a polar solvent. Such process can be illustrated by the following reaction scheme:

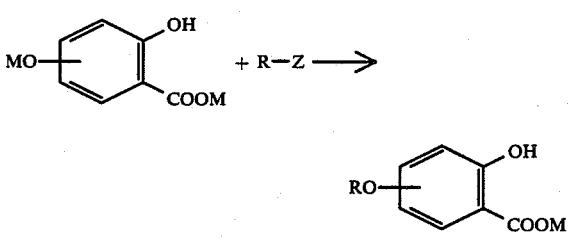

wherein R represents an alkyl group; Z represents a halogen atom, an alkylsulfonyloxy group or an arylsulfonyloxy group; and M represents an alkali metal atom.

The alkyl group as represented by R may have a substituent. Examples of the substituent include an aryl group, an alkoxy group, a halogen atom, an aryloxy group, etc. These groups may further have a substituent.

Of the substituents represented by Z, a halogen atom and an arylsulfonyloxy group are preferred, with a chlorine atom, a bromine atom, a benzenesulfonyloxy group and a toluenesulfonyloxy group being particularly preferred. M preferably represents lithium, sodium and potassium, with sodium and potassium being particularly preferred. The substitution position of MO is preferably the 4- or 5-position.

The polar solvents which can be used in the present invention preferably include solvents having a hydrophilic group, such as hydroxy, ether, carbonyl, sulfonyl, cyano, amido, etc. Preferred examples of such solvents include methyl ethyl ketone, acetonitrile, dimethylacetamide, acrylonitrile, N-methylpyrrolidone, hexamethylphosphoramide, sulforan, cyclohexanone, dimethylformamide, dimethyl sulfoxide, acetone, methanol, ethanol, etc. In particular, water-soluble solvents are desirable in view of easiness in working-up treating. These solvents are used so as to have a solid concentration of not less than 10%, and preferably not less than 20%.

Bases which can be used for formation of a phenolate preferably include metallic sodium, metallic potassium, sodium hydroxide, potassium hydroxide, sodium carbonate, potassium carbonate, sodium alcoholates, and potassium alcoholates. Metallic sodium, sodium hydroxide and sodium alcoholates are particularly useful. In carrying out the process in accordance with the present invention, it is desired that the amount of water present be as small as possible. Further, the reaction is preferably performed in an inert gas atmosphere.

From the viewpoint of reactivity and stability, the reaction temperature preferably ranges from 50° C. to 150° C., and more preferably from 65° C. to 100° C.

The alkyl halide or alkyl sulfonate which can be used in the present invention is preferably used in an amount of from 0.7 to 1.5 mols, and more preferably from 0.8 to 1.2 mols, per mol of the hydroxysalicylic acid.

SYNTHESIS EXAMPLE 1

In a flask equipped with a stirrer were weighed and placed 100 ml of dimethylacetamide and 0.1 mol of β-resorcylic acid. To the mixture was added 0.2 mol of sodium methylate while stirring, and 0.1 mol of dodecyl bromide was further added thereto while maintaining the inner temperature at 70° C. After stirring at 90° C. for 3 hours, the reaction mixture was poured into water. Crystals precipitated upon addition of dilute hydrochloric acid to render acidic.

The crystals were collected by filtration and washed with methanolic water to obtain 4-dodecyloxysalicylic acid (melting point: 98°-100° C.) in a yield of 85%.

SYNTHESIS EXAMPLE 2

In the same manner as in Synthesis Example 1, except for using p-methylbenzyl chloride in place of the dodecyl bromide as used in Synthesis Example 1, the reaction was carried out to obtain 4-p-methylbenzyloxysalicylic acid (melting point: 175°-177° C.) in a yield of 89%.

SYNTHESIS EXAMPLE 3

Reaction was carried out in the same manner as in Synthesis Example 1, except for using β-phenoxyethyl tosylate and sulforan in place of the dodecyl bromide and dimethylacetamide as used in Synthesis Example 1, to obtain 4-β-phenoxyethoxysalicylic acid (melting point: 114°-116° C.) in a yield of 78%.

SYNTHESIS EXAMPLE 4

Reaction was carried out in the same manner as in Synthesis Example 3, except for using β-p-methylphenoxyethyl tosylate in place of the β-phenoxyethyl tosylate as used in Synthesis Example 3, to obtain 4-β-p-tolyloxyethoxysalicylic acid (melting point: 209°-211° C.) in a yield of 80%.

SYNTHESIS EXAMPLE 5

Reaction was carried out in the same manner as in Synthesis Example 3, except for using β-p-methoxyphenoxyethyl tosylate in place of the β-phenoxyethyl tosylate as used in Synthesis Example 3, to obtain 4-β-p-methoxyphenoxyethoxysalicylic acid (melting point: 188-190° C.) in a yield of 85%.

This invention will now be illustrated in greater detail with reference to the following examples, but it should be understood that they are not intended to limit the present invention. In these examples, all the percents are given by weight unless otherwise indicated.

EXAMPLES 1 TO 8

In 100 g of a 5% aqueous solution of polyvinyl alcohol (Kuraray PVA 105, produced by Kuraray Co., Ltd.) was dispersed 20 g each of the electron donating leuco dye, electron accepting compound and heat-fusible substance shown in Table 1 in a ball mill for one day to prepare a dispersion having a volume average particle size of 3 μm. 80 g of the pigment shown in Table 1 were dispersed in 160 g of a 0.5% solution of sodium hexametaphosphate in a homogenizer.

5 g of the dispersion of the electron donating leuco dye, 10 g of the dispersion of the electron accepting compound, 5 g of the dispersion of the heat-fusible substance and 22 g of the dispersion of the pigment were mixed, and 4 g of a zinc stearate emulsion and 5 g of a 2% aqueous solution of sodium (2-ethylhexyl)sulfosuccinate were added thereto to prepare a coating composition. The resulting coating composition was coated on fine paper having a weight of 50 g/m$^2$ with a wire bar to a dry coverage of 6 g/m$^2$, dried in an oven at 50° C. for 5 minutes, and subjected to calendering so as to have a Bekk's degree of surface smoothness of 500 sec.

TABLE 1

| Example No. | Electron Donating Leuco Dye | Electron Accepting Compound | Heat-Fusible Substance | Pigment |
|---|---|---|---|---|
| 1 | 1:1 (by wt.) mixture of 2-anilino-3-chloro-6-diethylaminofluoran and 2-anilino-3-methyl-6-N—methyl-N—cyclohexylaminofluoran | 4-n-pentadecyl-salicylic acid | β-naphthyl-benzyl ether | 1:1 (by wt.) mixture of calcium carbonate and zinc oxide (Brilliant-15: zinc white No. 3) |
| 2 | 1:1 (by wt.) mixture of 2-anilino-3-chloro-6-diethylaminofluoran and 2-anilino-3-methyl-6-N—ethyl-N—isoamylaminofluoran | zinc 4-n-pentadecyl salicylate | phenyl 1-hydroxy-2-naphthoate | 1:1 (by wt.) mixture of calcium carbonate and zinc oxide |
| 3 | 1:1 (by wt.) mixture of 2-anilino-3-chloro-6-diethylaminofluoran and 2-anilino-3-methyl-6-N—ethyl-N—furylmethylaminofluoran | zinc 4-n-pentadecyl salicylate | 1-phenoxy-4-(ethyl-phenoxy) ethane | Calcined kaolin (Anisilex-93) |
| 4 | 1:1 (by wt.) mixture of 2-anilino-3-chloro-6-diethylaminofluoran and 2-anilino-3-methyl-6-N—ethyl-N—isoamylaminofluoran | zinc 4-n-pentadecyl salicylate | diethylene glycol-bis-(4-methoxy-phenyl) ether | 1:1 (by wt.) mixture of aluminum hydroxide and zinc oxide (Higilite H-42M) |
| 5 | Crystal Violet Lactone | zinc 4-t-dodecyl-salicylate | stearamide | 1:1 (by wt.) mixture of calcium carbonate and zinc oxide |
| 6 | 2-anilino-3-methyl-6-N—methyl-N—cyclohexylaminofluoran | zinc 4-n-heptadecyl-salicylate | β-naphthyl-benzyl ether | calcium carbonate |
| 7 | 1:1 (by wt.) mixture of 2-anilino-3-chloro-6-diethylaminofluoran and 2-anilino-3-methyl-6-N—ethyl-N—furylmethylaminofluoran | zinc 4-n-heptadecyl-salicylate | diethylene glycol-bis-(4-methoxy-phenyl) ether | 1:1 (by wt.) mixture of calcium carbonate and zinc oxide |
| 8 | 2-anilino-3-methyl-6-N—methyl-N—cyclohexylaminofluoran | zinc 4-n-heptadecyl-salicylate | β-naphthyl-benzyl ether | 1:1 (by wt.) mixture of calcium carbonate and zinc oxide |

COMPARATIVE EXAMPLES 1 to 5 heat-sensitive recording material was obtained in the same manner as described in Examples 1 to 5 but replacing the electron accepting compound as used in Examples 1 to 5 with each of the compounds shown in Table 2.

TABLE 2

| Comparative Example No. | Electron Accepting Compound |
|---|---|
| 1 | 2,2-bis(p-hydroxyphenyl)propane |
| 2 | benzyl p-hydroxybenzoate |
| 3 | dimethyl 3-hydroxy-o-phthalate |
| 4 | 1,1-bis(4'-hydroxyphenyl)cyclopropane |
| 5 | zinc 3,5-di-t-butylsalicylate |

Each of the heat-sensitive recording materials obtained in Examples 1 to 8 and Comparative Examples 1 to 5 was evaluated for heat sensitivity, chemical resistance, heat resistance and moisture resistance in accordance with the following methods.

Heat Sensitivity:

Test Chart No. 3 of The Image Electronics Institute was copied into the heat-sensitive recording material by the use of a high speed facsimile (FF-2000, manufactured by Fujitsu Ltd.). The density of the resulting copy was measured by a Macbeth densitometer (RD-918 Model).

Chemical Resistance:

The above obtained recorded layer of the heat-sensitive recording material was brought into contact with filter paper impregnated with ethanol, ethyl acetate, polyethylene glycol (600), castor oil, paraffin oil (100 seconds) or a diazo developer (Ricopy SD, produced by Ricoh Company Ltd.), and the degree of fog on the white background and the degree of color disappearance (discoloration) of the recorded area were visually evaluated according to the following rating:

Very excellent: No substantial change was observed.

Excellent: Slight changes were observed.

Practically usable: The recorded image was legible though suffering from fog or discoloration.

Unusable: The recorded image was very illegible due to fog or discoloration.

Heat- and Moisture-Resistance:

The heat-sensitive recording material on which an image was recorded with a thermal pen at 120° C. under a pressure of 500 g/cm$^2$ for 5 seconds was preserved for 24 hours under conditions of 60° C. and 30% RH (for evaluation of heat resistance) or conditions of 40° C. and 90% RH (for evaluation of moisture resistance). The fog densities on the white background and the densities on the recorded area before and after the preservation were measured by the use of a Macbeth densitometer (RD-918 Model). The density preservability on the recorded area (degree of color disappearance) was expressed in terms of (density after preservation/density immediately after color development)$\times$100 (%).

The results of these evaluations are shown in Table 3 below. It can be seen from Table 3 that the recording materials of the invention have very excellent performances, that is, they exhibit high heat sensitivities, provide images of high densities and undergo neither fog nor color disappearance due to contact with chemicals.

TABLE 3

| Performance | Example No. 1 | No. 2 | No. 3 | No. 4 | No. 5 | No. 6 | No. 7 | No. 8 | Comparative Example No. 1 | No. 2 | No. 3 | No. 4 | No. 5 |
|---|---|---|---|---|---|---|---|---|---|---|---|---|---|
| Heat Sensitivity (density) | 1.28 | 1.26 | 1.30 | 1.35 | 1.22 | 1.28 | 1.38 | 1.28 | 1.25 | 1.30 | 1.10 | 1.08 | 1.10 |
| Chemical Resistance: | | | | | | | | | | | | | |
| Ethanol: | | | | | | | | | | | | | |
| Fog | very excellent | very excellent | very excellent | very excellent | excellent | very excellent | very excellent | excellent | unusable | unusable | unusable | practically usable | unusable |
| Color Disappearance | excellent | excellent | excellent | excellent | excellent | excellent | excellent | excellent | (impossible to judge due to fog) | | | practically usable | unusable |
| Ethyl Acetate: | | | | | | | | | | | | | |
| Fog | excellent | excellent | excellent | excellent | practically usable | excellent | excellent | excellent | unusable | unusable | unusable | unusable | unusable |
| Color Disappearance | excellent | excellent | excellent | excellent | excellent | excellent | excellent | excellent | (impossible to judge due to fog) | | | practically usable | unusable |
| Polyethylene Glycol: | | | | | | | | | | | | | |
| Fog | very excellent | very excellent | very excellent | very excellent | very excellent | very excellent | very excellent | very excellent | practically usable | practically usable | excellent | excellent | practically usable |
| Color Disappearance | excellent | excellent | excellent | very excellent | practically usable | excellent | very excellent | excellent | unusable | unusable | unusable | unusable | excellent |
| Castor Oil: | | | | | | | | | | | | | |
| Fog | very excellent | very excellent | very excellent | very excellent | very excellent | very excellent | very excellent | very excellent | excellent | excellent | excellent | practically usable | practically usable |
| Color Disappearance | excellent | excellent | excellent | excellent | practically usable | practically usable | very excellent | excellent | unusable | unusable | unusable | unusable | practically usable |
| Paraffin Oil: | | | | | | | | | | | | | |
| Fog | very excellent | very excellent | very excellent | very excellent | very excellent | very excellent | very excellent | very excellent | excellent | excellent | excellent | practically usable | practically usable |
| Color Disappearance | excellent | excellent | excellent | excellent | practically usable | practically usable | very excellent | excellent | unusable | unusable | unusable | unusable | practically usable |
| Diazo Developer: | | | | | | | | | | | | | |
| Fog | excellent | excellent | excellent | excellent | very excellent | excellent | excellent | very excellent | unusable | unusable | unusable | practically usable | unusable |
| Color Disappearance | excellent | excellent | excellent | excellent | very excellent | excellent | very excellent | practically usable | unusable | unusable | unusable | unusable | excellent |
| Heat Resistance: | | | | | | | | | | | | | |
| Fog | 0.10 | 0.09 | 0.11 | 0.09 | 0.12 | 0.08 | 0.09 | 0.10 | 0.12 | 0.30 | 0.15 | 0.11 | 0.42 |
| Color Disappearance (%) | 95 | 96 | 98 | 99 | 98 | 98 | 98 | 99 | 65 | 48 | 35 | 52 | 89 |
| Moisture Resistance: | | | | | | | | | | | | | |
| Fog | 0.08 | 0.07 | 0.09 | 0.08 | 0.10 | 0.09 | 0.08 | 0.09 | 0.10 | 0.24 | 0.10 | 0.10 | 0.28 |
| Color Disappearance (%) | 96 | 98 | 99 | 98 | 98 | 98 | 99 | 99 | 80 | 60 | 46 | 71 | 91 |

EXAMPLE 9

Preparation of Color Forming Sheet

In 30 g of an alkylated naphthalene (mono-, di- or triisopropylnaphthalene) was dissolved 1 g of 2-anilino-3-methyl-6-diethylaminofluoran as an electron donating leuco dye. The solution was emulsified in 50 g of water having dissolved therein 6 g of gelatin and 4 g of gum arabic while vigorously stirring to form oil droplets having a diameter of from 1 to 10 μm. To the emulsion was added 250 g of water. The emulsion was then adjusted to a pH of about 4 by adding acetic acid in small portions to induce coacervation thereby forming the oil droplets. After formalin was added thereto, the pH of the system was raised to 9 to harden the capsule walls.

The thus prepared microcapsule dispersion was ocated on paper and dried to obtain a color forming sheet.

Preparation of Color Developing Sheet

In 200 g of a 5% aqueous solution of polyvinyl alcohol was dispersed 20 g of zinc 4-dodecyloxysalicylate as an electron accepting compound, and 20 g of kaolin (Georgia Kaolin) was added thereto followed by thoroughly dispersing. The resulting coating composition was coated on paper and dried to obtain a color developing sheet.

When the color forming sheet and color developing sheet as above prepared were brought into intimate contact with each other and pressure or shock was applied thereto, a black image was instantaneously obtained. The resulting image had a high density and was excellent in resistance to light and heat.

EXAMPLE 10

A color developing sheet was prepared in the same manner as described in Example 9 but replacing zinc 4-dodecyloxysalicylate with 10 g of zinc 3,5-bis(α-methylbenzyl)salicylate and 10 g of zinc 4-tetradecyloxysalicylate.

When color development was effected using the resulting sheet in the same manner as in Example 9, a black image having a high density and excellent resistance to light and heat was obtained.

EXAMPLES 11 TO 18

In 100 g of a 5% aqueous solution of polyvinyl alcohol (Kuraray PVA 105, produced by Kuraray Co., Ltd.) was dispersed 20 g each of the electron donating leuco dye, electron accepting compound and heat-fusible substance shown in Table 4 for one day by means of a ball mill to prepare a dispersion having a volume average particle size of 3 μm. 80 g of calcined kaolin (Anisilex 93) were dispersed in 160 g of a 0.5% solution of sodium hexametaphosphate in a homogenizer.

5 g of the dispersion of the electron donating leuco dye, 10 g of the dispersion of the electron accepting compound, 5 g of the dispersion of the heat-fusible substance and 22 g of the dispersion of calcined kaolin were mixed, and 4 g of a zinc stearate emulsion and 5 g of a 2% aqueous solution of sodium (2-ethylhexyl)sulfosuccinate were added thereto to prepare a coating composition. The resulting coating composition was coated on fine paper having a basis weight of 50 g/m$^2$ with a wire bar to a dry coverage of 6 g/m$^2$, dried in an oven at 50° C. for 5 minutes, and subjected to calendering to obtain a recording material.

COMPARATIVE EXAMPLES 6 TO 10

A recording material was produced in the same manner as described in Example 11 but replacing the electron accepting compound as used in Example 11 with the compounds shown in Table 5 below.

TABLE 4

| Example No. | Electron Donating Leuco Dye | Electron Accepting Compound | Heat-Fusible Substance |
|---|---|---|---|
| 11 | 1:1 (by wt.) mixture of 2-anilino-3-chloro-6-diethylaminofluoran and 2-anilino-3-methyl-6-N—methyl-N—cyclohexylaminofluoran | zinc 4-dodecyloxysalicylate | 2-benzyloxynaphthalene |
| 12 | 1:1 (by wt.) mixture of 2-anilino-3-chloro-6-diethylaminofluoran and 2-anilino-3-methyl-6-N—methyl-N—cyclohexylaminofluoran | zinc 4-octadecyloxy-salicylate | 2-benzyloxynaphthalene |
| 13 | 1:1 (by wt.) mixture of 2-anilino-3-chloro-6-diethylaminofluoran and 2-anilino-3-methyl-6-N—methyl-N—cyclohexylaminofluoran | 4-octadecyloxysalicylic acid | 2-benzyloxynaphthalene |
| 14 | 1:1 (by wt.) mixture of 2-anilino-3-chloro-6-diethylaminofluoran and 2-anilino-3-methyl-6-N—methyl-N—cyclohexylaminofluoran | 1:1 (by wt.) mixture of zinc 4-dodecyloxysalicylate and 1,3-bis(4-hydroxycumyl)-benzene | 2-benzyloxynaphthalene |
| 15 | 1:1 (by wt.) mixture of 2-anilino-3-chloro-6-diethylaminofluoran and 2-anilino-3-methyl-6-N—methyl-N—cyclohexylaminofluoran | 1:1 (by wt.) mixture of zinc 4-dodecyloxysalicylate and benzyl 4-hydroxy-benzoate | 2-benzyloxynaphthalene |
| 16 | 1:1 (by wt.) mixture of 2-anilino-3-chloro-6-diethylaminofluoran and 2-anilino-3-methyl-6-N—ethyl-N—isoamylaminofluoran | zinc 4-β-p-t-octylphenoxy-ethoxysalicylate | 1-phenoxy-2-(4-ethyl-phenoxy)ethane |
| 17 | 2-anilino-3-chloro-6-diethylaminofluoran | zinc 4-β-N—myristoylamino-ethoxysalicylate | phenyl 1-hydroxy-2-naphthoate |
| 18 | 2-anilino-3-methyl-6-N—ethyl-N—isoamylamino fluoran | zinc 4-p-t-octylphenyloxy-salicylate | diethylene glycol bis(4-methoxyphenyl) ether |

TABLE 5

| Comparative Example No. | Electron Accepting Compound |
|---|---|
| 6 | 2,2-bis(p-hydroxyphenyl)propane |
| 7 | benzyl p-hydroxybenzoate |
| 8 | dimethyl 3-hydroxy-o-phthalate |
| 9 | 1,1-bis(4'-hydroxyphenyl)cyclopropane |
| 10 | zinc 3,5-di-t-butylsalicylate |

Each of the recording materials obtained in Examples 11 to 18 and Comparative Examples 6 to 10 was evaluated for color density and chemical resistance in the same manner as described in Examples 1 to 8 and Comparative Examples 1 to 5. The results obtained are shown in Table 6 below.

TABLE 6

| | Color Density | Chemical Resistance: Ethanol Fog | Ethanol Color Disappearance | Castor Oil Fog | Castor Oil Color Disappearance |
|---|---|---|---|---|---|
| Example No. | | | | | |
| 11 | 1.25 | very excellent | excellent | very excellent | excellent |
| 12 | 1.24 | very excellent | excellent | very excellent | excellent |
| 13 | 1.20 | very excellent | excellent | very excellent | excellent |
| 14 | 1.25 | very excellent | excellent | very excellent | excellent |
| 15 | 1.25 | excellent | practically usable | very excellent | practically usable |
| 16 | 1.20 | very excellent | excellent | very excellent | excellent |
| 17 | 1.18 | excellent | excellent | very excellent | excellent |
| 18 | 1.22 | very excellent | excellent | very excellent | excellent |
| Comparative Example No. | | | | | |
| 6 | 1.10 | unusable | seriously unusable* | excellent | unusable |
| 7 | 1.25 | unusable | seriously unusable* | excellent | unusable |
| 8 | 1.18 | unusable | seriously unusable* | excellent | unusable |
| 9 | 1.05 | practically usable | practically usable | practically usable | unusable |
| 10 | 1.10 | unusable | seriously unusable | practically usable | practically usable |

Note:
*"Seriously unusable" means that illegibility of the recorded image due to fog or discoloration is more serious than "unusable".

It can be seen from Table 6 that the recording materials according to the present invention have very excellent performances, that is, they exhibit high sensitivities and undergo neither fog nor color disappearance due to contact with chemicals.

EXAMPLE 19

A color developing sheet was prepared in the same manner as described in Example 9 but replacing zinc 4-dodecyloxysalicylate used as an electron accepting compound with zinc 4-β-phenoxyethyloxysalicylate.

When the resulting color developing sheet and the same color forming sheet as prepared in Example 9 were brought into intimate contact with each other and pressure or shock was applied thereto, a black image was obtained instantaneously. This image had a high density and excellent resistance to light and heat.

EXAMPLE 20

A color developing sheet was prepared in the same manner as in Example 19 but replacing zinc 4β-phenoxyethyloxysalicylate used as an electron accepting compound with 10 g of zinc 3,5-bis(α-methylbenzyl)salicylate and 10 g of zinc 4-β-p-tolyloxyethoxysalicylate.

When color development was effected using the resulting sheet in the same manner as in Example 19, a black image having a high density and excellent resistance to light and heat was obtained.

EXAMPLES 21 to 28

A recording material was prepared in the same manner as described in Examples 11 to 18 but replacing the electron accepting compounds as used in Examples 11 to 18 with the compunds shown in Table 7. With respect to the electron donating leuco dye and heat-fusible substance, Examples 21to 28 correspond to Example 11 to 18, respectively.

TABLE 7

| Example No. | Electron Accepting Compound |
|---|---|
| 21 | zinc 4-β-phenoxyethoxysalicylate |
| 22 | zinc 4-β-p-tolyloxyethoxysalicylate |
| 23 | zinc 4-β-p-methoxyphenoxyethoxy-salicylate |
| 24 | zinc 4-β-p-ethylphenoxyethoxy-salicylate |
| 25 | zinc 4-β-p-ethoxyphenoxyethoxy-salicylate |
| 26 | zinc 4-(8-phenoxyoctyloxy)salicylate |
| 27 | 4-(4-p-t-butylphenoxybutyloxy)-salicylic acid |
| 28 | zinc 4-β-p-benzyloxycarbonylphenoxy-ethoxysalicylate |

Each of the thus obtained recording materials was evaluated for color density and chemical resistance in the same manner as described in Examples 1 to 8, and the results obtained are shown in Table 8.

TABLE 8

| Example No. | Color Density | Chemical Resistance: Ethanol Fog | Ethanol Color Disappearance | Castor Oil Fog | Castor Oil Color Disappearance |
|---|---|---|---|---|---|
| 21 | 1.25 | excellent | excellent | very excellent | excellent |
| 22 | 1.08 | very excellent | excellent | very excellent | excellent |
| 23 | 1.12 | very excellent | very excellent | very excellent | excellent |
| 24 | 1.14 | very | excellent | very | excellent |

TABLE 8-continued

| Example No. | Color Density | Chemical Resistance: Ethanol: Fog | Ethanol: Color Disappearance | Castor Oil: Fog | Castor Oil: Color Disappearance |
|---|---|---|---|---|---|
| 25 | 1.18 | excellent very excellent | excellent | excellent very excellent | excellent |
| 26 | 1.20 | very excellent | excellent | very excellent | practically usable |
| 27 | 1.15 | very excellent | excellent | very excellent | excellent |
| 28 | 1.07 | very excellent | excellent | very excellent | practically usable |

It can be seen from Table 8 in view of the comparative results of Table 6 that the recording materials in accordance with the present invention have very excellent performances, that is, they exhibit high densities and undergo neither fog nor color disappearance due to contact with chemicals.

EXAMPLE 29

In 100 g of a 5% aqueous solution of polyvinyl alcohol (Kuraray PVA 105, produced by Kuraray Co., Ltd.) was dispersed 20 g each of 1:1 (by wt.) mixture of 2-anilino-3-chloro-6-diethylaminofluoran and 2-anilino-3-methyl-6-N-ethyl-N-isoamylaminofluoran as an electron donating leuco dye, 4-β-p-methoxyphenoxyethoxysalicylic acid as an electron accepting compound, and stearic acid amide as a heat-fusible substance in a ball mill for one day to prepare a dispersion having a volume average particle size of 3 μm. 80 g of the 1:1 (by wt.) mixture of calcium carbonate and zinc oxide as a pigment were dispersed in 160 g of a 0.5% solution of sodium hexametaphosphate in a homogenizer.

5 g of the dispersion of the electron donating leuco dye, 10 g of the dispersion of the electron accepting compound, 5 g of the dispersion of the heat-fusible substance and 22 g of the dispersion of the pigment were mixed, and 4 g of a zinc stearate emulsion and 5 g of a 2% aqueous solution of sodium (2-ethylhexyl)sulfosuccinate were added thereto to prepare a coating composition. The resulting coating composition was coated on fine paper having a weight of 50 g/m$^2$ with a wire bar to a dry coverage of 7 g/m$^2$, dried in an oven at 50° C., and subjected to calendering so as to have a Bekk's degree of surface smoothness of 500 sec.

The recording material obtained was evaluated for chemical resistance, and heat- and moisture-resistance in the same manner as described in Examples 1 to 8. As a result, fog on the white background and color disappearance or discoloration of the recorded area were almost not caused.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having at least one layer thereon containing an electron donating leuco dye an an electron accepting compound, where in said electron accepting compound is a salicylic acid derivative or a metal salt thereof represented by formula (II):

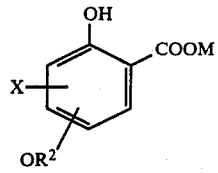

(II)

wherein $R^2$ represents an alkyl group having from 7 to 18 carbon atoms; X represents a hydrogen atom, a substituted or unsubstituted alkyl group, a substituted or unsubstituted alkoxy group or a halogen atom; and M represents a hydrogen atom or $M_1^{1/n}$ wherein $M_1$ represents a n-valent metal atom, and n represents an integer corresponding to the valance number of the metla atom; and —$OR^2$ is bonded to the para-position with respect to —COOM.

2. A recording material as in claim 1, wherein $M_1$ represents a zinc atom, an aluminum atom, a magnesium atom or a calcium atom.

3. A recording material as in claim 1, wherein said salicylic acid derivative having an alkoxy group as a substituent or a metal salt thereof is a compound produced by reacting a hydroxysalicylic acid derivative with an alkyl halide or an alkyl sulfonate in a polar solvent.

4. A recording material as in claim 3, wherein said hydroxysalicylic acid derivative is a phenolated hydroxysalicylic acid derivative.

5. A recording material as in claim 3, wherein said alkyl halide or alkyl sulfonate is an alkyl chloride, an alkyl bromide or an alkyl-p-toluene-sulfonate.

6. A recording material as in claim 3, wherein said polar solvent is a solvent having a hydrophilic group.

7. A recording material as in claim 6, wherein said hydrophilic group is a group selected from hydroxy, ether, carbonyl, sulfonyl, cyano or amido.

8. A recording material as in claim 1, wherein said recording material is a pressure-sensitive recording material.

9. A recording material as in claim 1, wherein said recording material is a heat-sensitive recording material.

10. A recording material comprising a support having at least one layer thereon containing electron donating leuco dye and an electron accepting compound, wherein said electron accepting compound is a salicylic acid derivative or a metal salt thereof represented by formula (III):

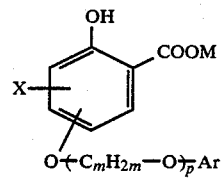

(III)

wherein Ar represents a substituted or unsubstituted aryl group; X represents a hydrogen atom, a substituted or unsubstituted alkyl group, a substituted or unsubstituted alkoxy group or a halogen atom; M represents a hydrogen atom or $M_1^{1/n}$, wherein $M_1$ represents an n-valent metal atom, and n represents an integer corresponding to the valence number of the metal atom; m represents an integer of from 1 to 10; and p represents an integer of 1 to 3.

11. A recording material as in claim 10, wherein said m represents 2.

12. A recording material as in claim 10, wherein $M_1$ represents a zinc atom, an aluminum atom, a magnesium atom or a calcium atom.

13. A recording material as in claim 10, wherein $O\text{-}(C_mH_{2m}\text{—}O)_pAr$ is bonded at the para-position with respect to COOM.

14. A recording material as in claim 10, wherein said salicylic acid derivative having an alkoxy group as a substituent or a metal salt thereof is a compound produced by reacting a hydroxysalicylic acid derivative with an alkyl halide or an alkyl sulfonate in a polar solvent.

15. A recording material as in claim 14, wherein said hydroxysalicylic acid derivative is a phenolated hydroxysalicylic acid derivative.

16. A recording material as in claim 14, wherein said alkyl halide or an alkyl sulfonate is an alkyl chloride, an alkyl bromide or alkyl-p-toluenesufonate.

17. A recording material as in claim 14, wherein said polar solvent is a solvent having a hydrophilc group.

18. A recording material as in claim 17, wherein said hydrophilic group is a group selected from hydroxy, ether, carbonyl, sulfonyl, cyano or amido.

19. A recording material as in claim 10, wherein said recording material is a pressure-sensitive recording material.

20. A recording material as in claim 10, wherein said recording material is a heat-sensitive recording material.

* * * * *